US009113711B2

(12) United States Patent
Bock

(10) Patent No.: US 9,113,711 B2
(45) Date of Patent: Aug. 25, 2015

(54) ARMREST, IN PARTICULAR FOR AN OFFICE CHAIR

(75) Inventor: Hermann Bock, Pyrbaum (DE)

(73) Assignee: Bock 1 GmbH & Co. KG, Postbauer-Heng (DE)

( * ) Notice: Subject to any disclaimer, the term of this patent is extended or adjusted under 35 U.S.C. 154(b) by 867 days.

(21) Appl. No.: 13/346,161

(22) Filed: Jan. 9, 2012

(65) Prior Publication Data

US 2012/0175934 A1 Jul. 12, 2012

(30) Foreign Application Priority Data

Jan. 10, 2011 (DE) ..... 10 2011 008 172

(51) Int. Cl.
*A47C 7/54* (2006.01)
*A47C 1/03* (2006.01)

(52) U.S. Cl.
CPC ..... *A47C 1/03* (2013.01)

(58) Field of Classification Search
CPC ..... A47C 7/54; A47C 1/03
USPC ..... 297/411.37, 411.35, 411.38
See application file for complete search history.

(56) References Cited

U.S. PATENT DOCUMENTS

| | | | | |
|---|---|---|---|---|
| 5,634,537 | A * | 6/1997 | Thorn | 188/300 |
| 5,641,203 | A | 6/1997 | Van De Riet et al. | |
| 5,927,811 | A * | 7/1999 | Tseng | 297/353 |
| 6,017,091 | A * | 1/2000 | Cao | 297/411.37 |
| 6,502,904 | B1 * | 1/2003 | Hansen | 297/411.35 |
| 6,908,158 | B2 * | 6/2005 | Willette et al. | 297/411.37 |
| 6,948,774 | B2 | 9/2005 | Maier et al. | |
| 7,159,947 | B1 * | 1/2007 | Lee | 297/411.37 |
| 7,188,907 | B1 * | 3/2007 | Lai | 297/411.35 |
| 7,387,341 | B1 * | 6/2008 | Tsai | 297/411.35 |
| 8,061,778 | B2 | 11/2011 | Machael et al. | |
| 2002/0036422 | A1 * | 3/2002 | Prince et al. | 297/411.35 |
| 2003/0178882 | A1 * | 9/2003 | Schmitz et al. | 297/411.36 |
| 2004/0130200 | A1 | 7/2004 | Willette et al. | |
| 2005/0146192 | A1 * | 7/2005 | Trego et al. | 297/411.37 |
| 2006/0226691 | A1 * | 10/2006 | Bedford et al. | 297/411.36 |
| 2008/0084103 | A1 | 4/2008 | Bock | |
| 2008/0309141 | A1 * | 12/2008 | Machael et al. | 297/411.36 |
| 2009/0033139 | A1 * | 2/2009 | Machael et al. | 297/411.37 |

FOREIGN PATENT DOCUMENTS

| | | | |
|---|---|---|---|
| DE | 20304136 | U1 | 4/2004 |
| DE | 20 2005 005 988 | U1 | 7/2005 |

(Continued)

*Primary Examiner* — David R Dunn
*Assistant Examiner* — Tania Abraham
(74) *Attorney, Agent, or Firm* — Laurence A. Greenberg; Werner H. Stemer; Ralph E. Locher

(57) ABSTRACT

In order to provide an adjustment mechanism for the arm support of an armrest, which is particularly simple structurally and which also enables a particularly flat style of construction, a locking device is proposed for releasably locking the base platform and the carrier platform in different positions with respect to each other, said locking device comprising a transfer element, which is arranged between carrier platform and arm support and is connected to the base platform and which has first blocking elements for blocking the longitudinal adjustment of the arm support and second blocking elements for blocking the transverse adjustment of the arm support, and an actuating element, which is arranged between carrier platform and arm support and is provided with a control button for manual actuation and which has elements for simultaneously blocking or releasing the first and second blocking elements of the transfer element.

10 Claims, 6 Drawing Sheets

(56) References Cited

FOREIGN PATENT DOCUMENTS

| | | | |
|---|---|---|---|
| DE | 20 2009 010 587 | U1 | 12/2010 |
| DE | 202009010587 | U1 | 12/2010 |
| EP | 0 809 957 | A2 | 12/1997 |
| EP | 1 405 582 | A1 | 4/2004 |
| EP | 1457140 | A2 | 9/2004 |
| GB | 2 477 111 | A | 7/2011 |
| WO | 2008112920 | A1 | 9/2008 |

* cited by examiner

ARMREST, IN PARTICULAR FOR AN OFFICE CHAIR

CROSS-REFERENCE TO RELATED APPLICATION

This application claims the priority, under 35 U.S.C. §119, of German patent application DE 10 2011 008 172.0, filed Jan. 10, 2011; the prior application is herewith incorporated by reference in its entirety.

BACKGROUND OF THE INVENTION

Field of the Invention

The invention relates to an armrest, in particular to an armrest for an office chair. More specifically, the invention relates to an armrest having a preferably height-adjustable armrest column, an arm support mounted on the armrest column and having a bearing head, which serves for the bearing arrangement of the arm support on the armrest column, is attached to the armrest column and has a longitudinal and a transverse adjustment mechanism for longitudinal or transverse adjustment of the arm support.

Different designs of these types of armrests are known from the prior art. In the case of these prior art armrests, to realize the longitudinal or transverse adjustment of the arm support, the bearing head, in the majority of cases, has structurally expensive adjustment mechanisms which, over and above this, also require a large installation space such that the armrests are not only comparatively expensive to produce, but are clearly built-up in part in the region of the arm support. In addition, the actuating devices required for actuating the adjustment mechanisms clearly project in part out of the armrest column or the arm support, which is frequently undesirable from a structural and/or ergonomic standpoint.

SUMMARY OF THE INVENTION

It is accordingly an object of the invention to provide an armrest assembly which overcomes the above-mentioned disadvantages of the heretofore-known devices of this general type and which provides for an adjustment mechanism for the arm support of an armrest which is particularly simple structurally and also enables a particularly flat style of construction.

With the foregoing and other objects in view there is provided, in accordance with the invention, an armrest, in particular for an office chair, comprising:

an armrest column;

an arm support mounted on said armrest column; and a bearing head attached to said armrest column, said bearing head supporting said arm support on said armrest column and having a longitudinal adjustment mechanism for a longitudinal adjustment of said arm support and a transverse adjustment mechanism for a transverse adjustment of said arm support;

said bearing head including:

a stationary base platform connected to said armrest column;

a movable carrier platform connected to said arm support; and a locking device for detachably locking said base platform and said carrier platform in different positions with respect to one another;

said locking device including:

a transfer element disposed between said carrier platform and said arm support and connected to said base platform, said transfer element having first blocking elements for blocking the longitudinal adjustment of said arm support and second blocking elements for blocking the transverse adjustment of said arm support; and an actuating element disposed between said carrier platform and said arm support, said actuating element having a control button for manual actuation and elements for simultaneously blocking or simultaneously releasing said first and second blocking elements of said transfer element.

In other words, a core concept of the invention is to provide a locking device which has an actuating element, which is arranged between the carrier platform and the arm support, for simultaneously blocking or releasing all participating assemblies as well as a transfer element, which is arranged between the carrier platform and the arm support and which transfers the blocking functionality of the actuating element to the individual components. Consequently, a longitudinal and transverse adjustment can be realized in a comparatively simple manner using few components. This means that not only are the production costs reduced, error susceptibility also falls. As a result, a particularly reliable adjustment mechanism is provided which can be realized in the smallest space.

As a result of the advantageous dual function of the transfer element, which, on the one hand, executes the transverse movement together with the carrier platform and serves as a guide element for the longitudinal movement of the carrier platform and, on the other hand, has blocking elements both for blocking the longitudinal adjustment and for blocking the transverse adjustment, the use of further components can be dispensed with. On account of the selected construction concept, the necessary components can be positioned with respect to each other in the final assembly state such that they fill out the space, which is there anyway, between carrier platform and arm support and, over and above this, such that they are arranged more or less fitting into each other, as a result of which an extremely low installation height is produced.

Other features which are considered as characteristic for the invention are set forth in the appended claims.

Although the invention is illustrated and described herein as embodied armrest, in particular for an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
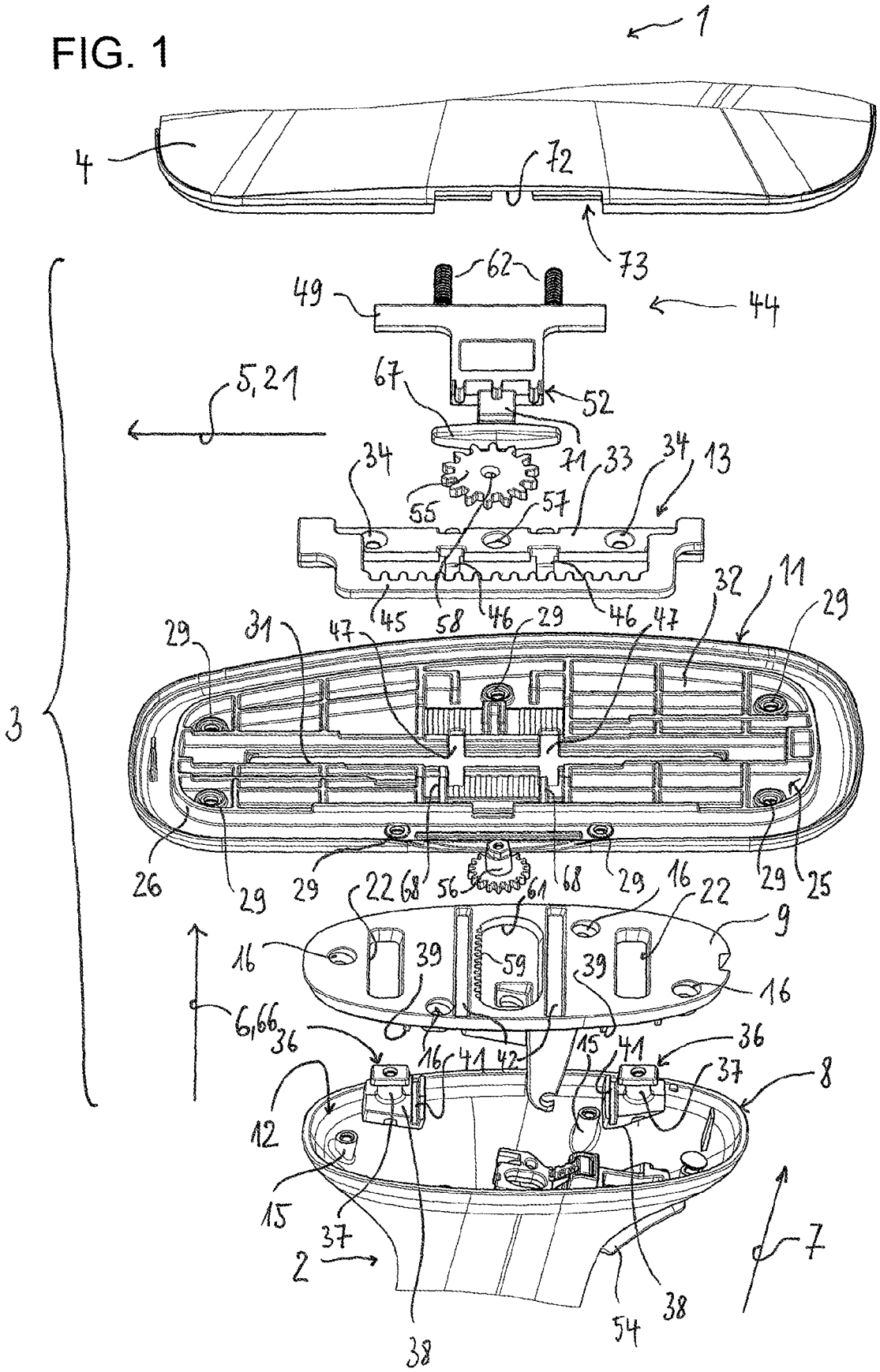
FIG. 1 shows a perspective view, from above, of an exploded representation of an armrest according to the invention.
Figure 2:
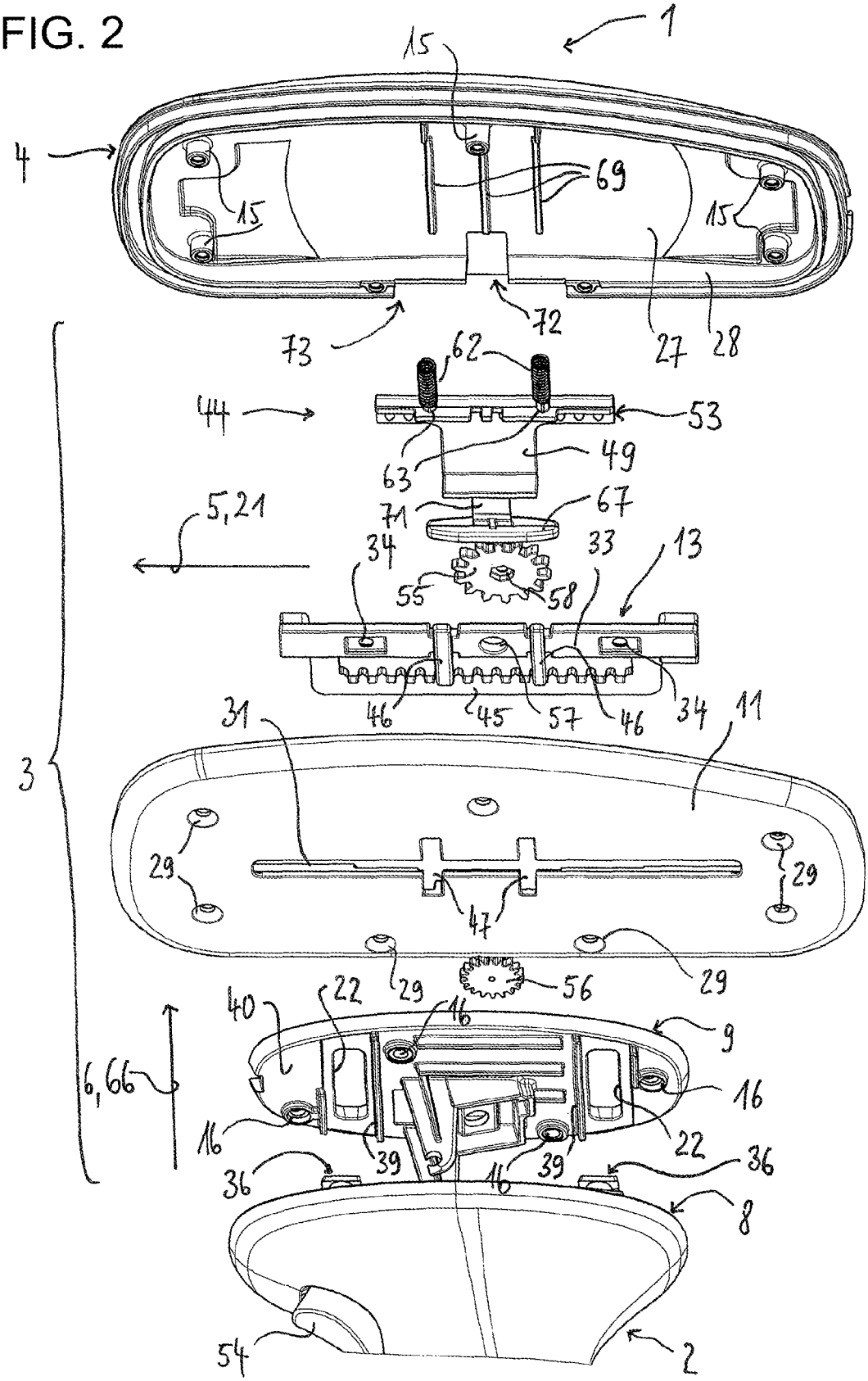
FIG. 2 shows a perspective view, from below, of an exploded representation of the armrest.
Figure 3:
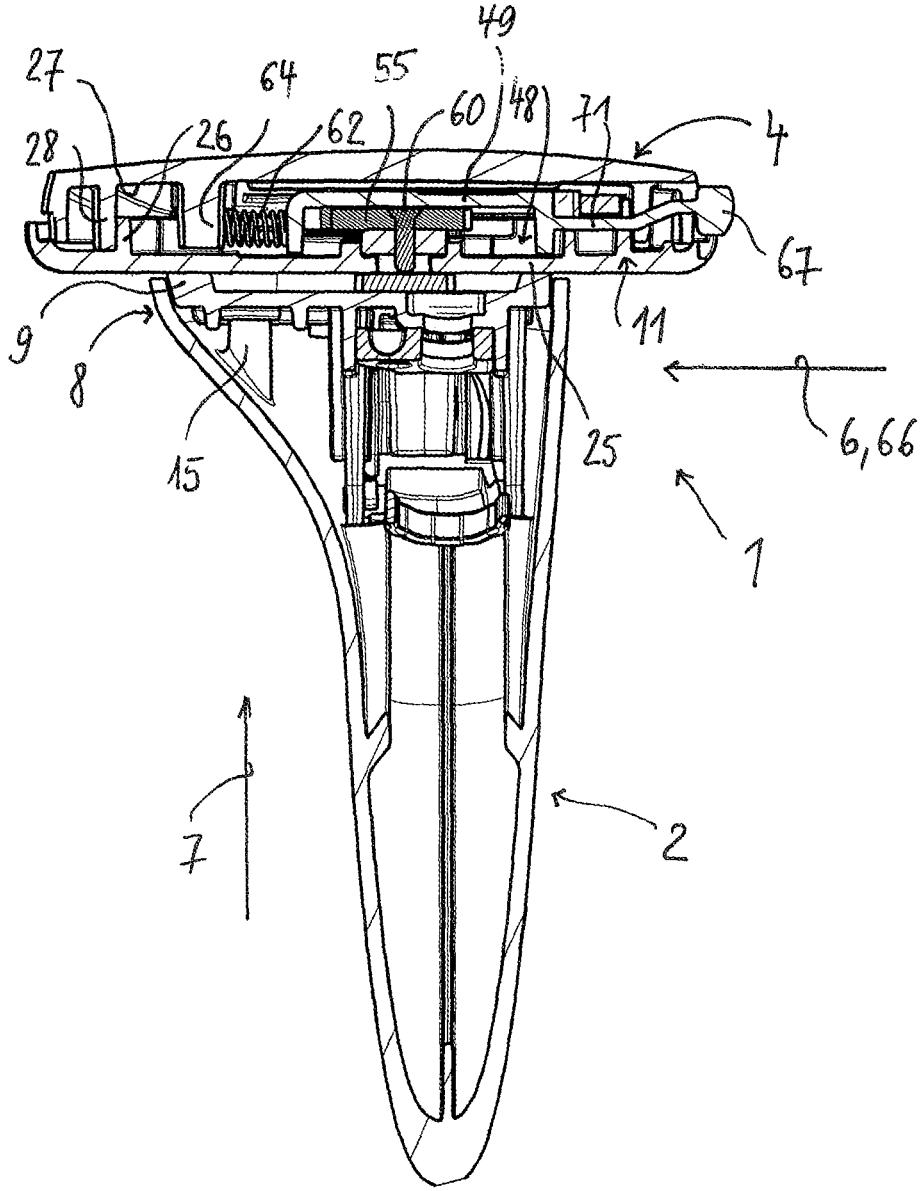
FIG. 3 shows a cross section taken through the armrest.
Figure 4:
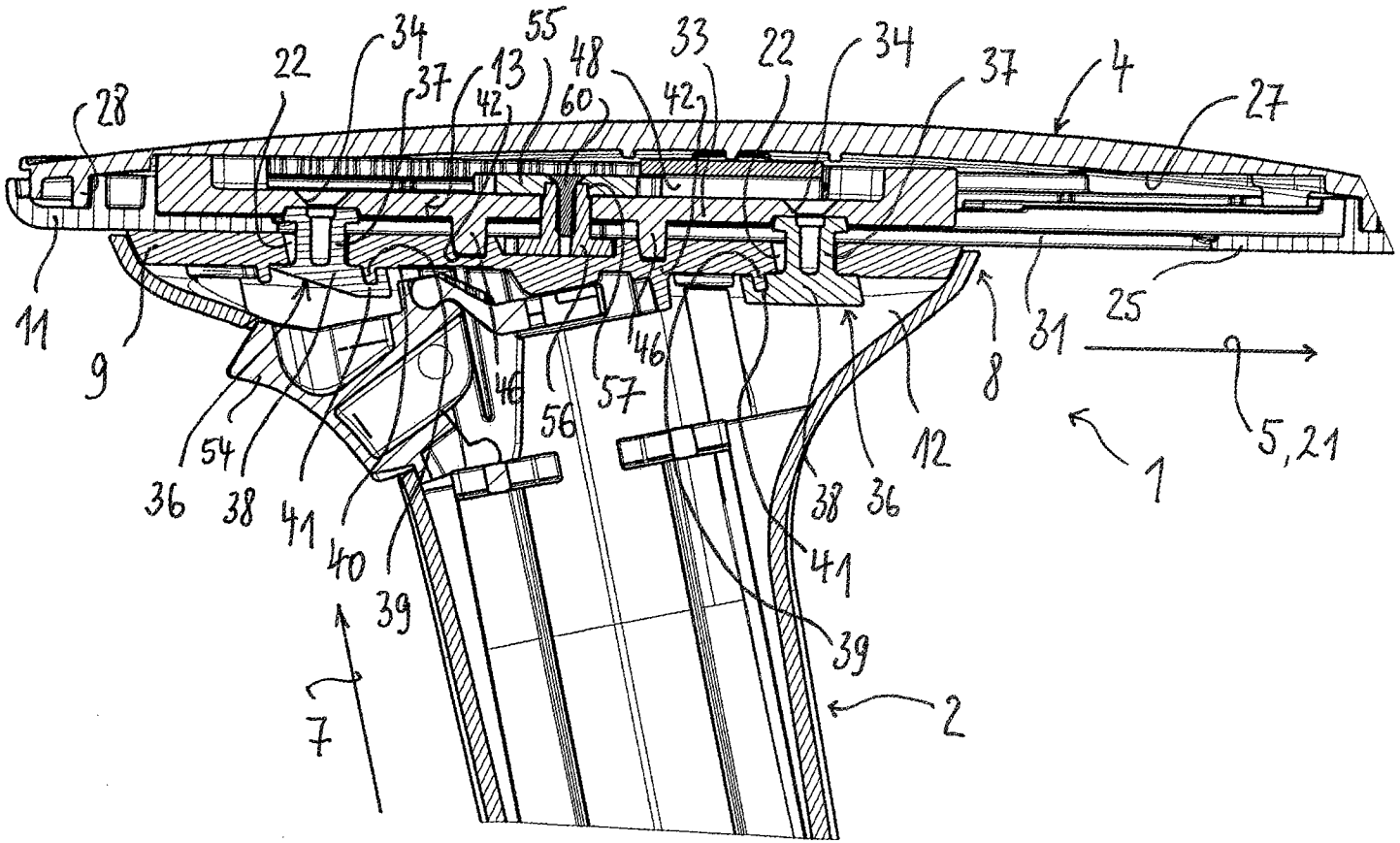
FIG. 4 shows a longitudinal section taken through the armrest.
Figure 5:
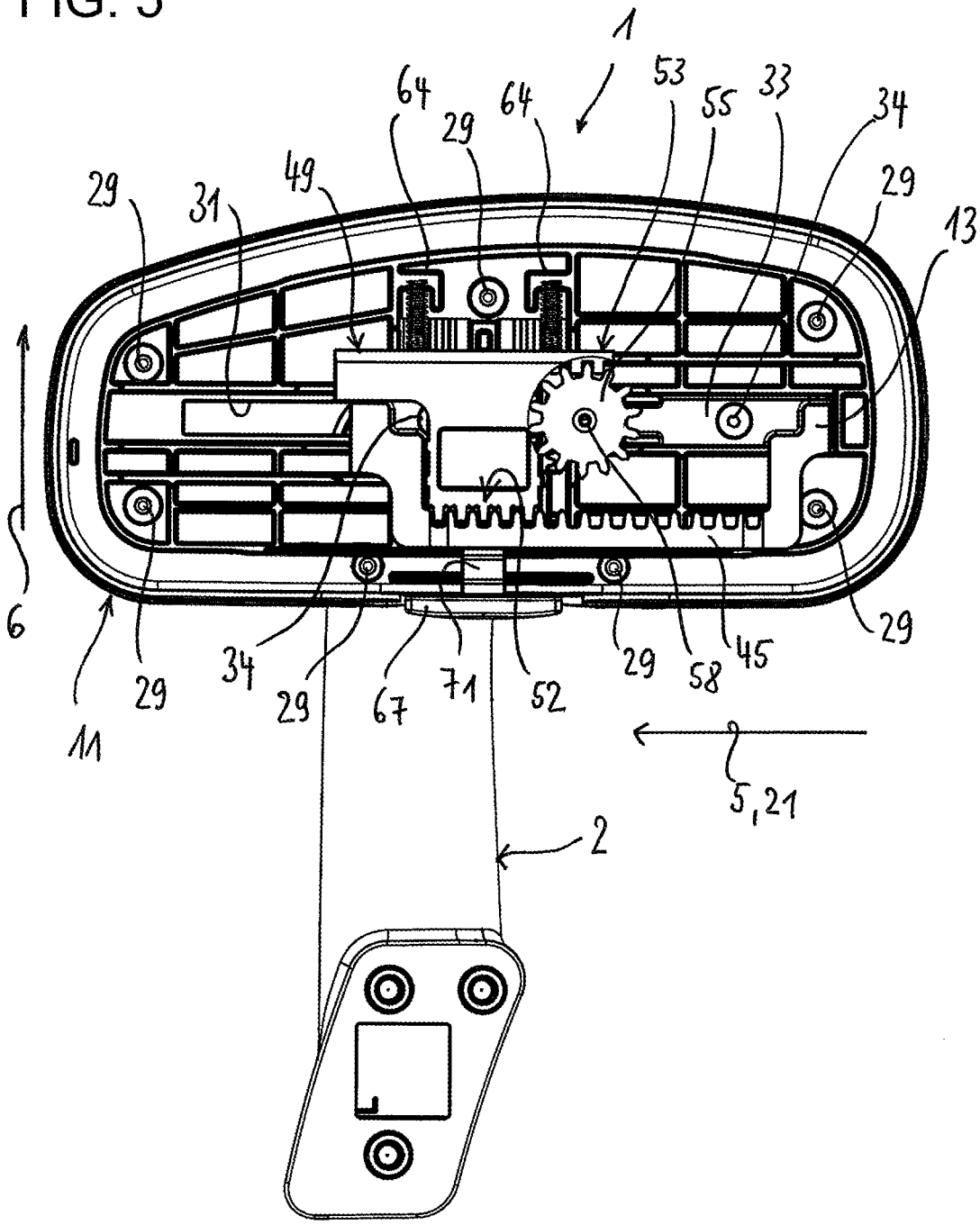
FIG. 5 shows a top view of the armrest with the arm support removed, in the locking position.

Referring now to the figures of the drawing in detail, there is shown an armrest 1 that includes a height-adjustable armrest column 2, which is preferably constructed in a telescopic manner and on the upper end of which a bearing head 3 is arranged. The bearing head 3 supports an arm support 4 and is realized for displacing the arm support 4 in relation to the armrest column 2 both in the longitudinal direction 5 and in the transverse direction 6. The support cushioning of the arm support 4 is not shown.

A non-illustrated vertical portion of the armrest column 2 is realized as a guide stand, on which the outer sleeve of the armrest column 2 is guided so as to be displaceable in the vertical direction 7. A height-adjustment locking means is installed in the guide stand. An actuating control button 54 that is provided for the height-adjustment of the armrest 1 is arranged laterally on the armrest column 2. A horizontal portion (not shown) that is integrally formed on the vertical portion of the armrest column 2 serves for fastening the armrest 1 to the support structure of an office chair or the like.

At the upper end of the armrest column 2, the outer sleeve flares outward in relation to the actual column part and thus forms a carrier 8 for the bearing head 3. The bearing head 3 consists primarily of a fixed base platform 9 which is connected to the armrest column 2 and a carrier platform 11 which is connected to the arm support 4 and is movable horizontally in the transverse direction 6 and the longitudinal direction 7.

The outer sleeve is upwardly open, the opening 12 being closed by the base platform 9 of the bearing head 3 in the manner of a cover. The base platform 9 is connected to the armrest column 2 by way of a plurality of non-illustrated fixing screws. The fixing screws are guided through openings 16 formed in the base platform 9 and cooperate with screw threads which are provided in support elements 15, which are arranged in the opening 12 of the outer sleeve extending upwards in the shape of a dome to provide additional support of the base platform 9.

The base platform 9 has two guide channels 22, which are arranged spaced apart from each other, run transversely with respect to the longitudinal direction 21 of the arm support, essentially have a rectangular contour, run in a straight line, extend substantially over the entire width of the base platform 9 and determine the measurement of the maximum adjustment of the arm support 4 in the transverse direction 6.

The carrier platform 11 is arranged above the base platform 9. The carrier platform 11 includes a base element 25, which, with a circumferential support element 26 that is arranged close to the edge, forms an upwardly open housing, onto which the arm support 4 is placed. In the mounted state, the circumferential support element 26 abuts against the inside of a circumferential retaining wall 28, which is provided on the underside 27 of the arm support 4, and thereby ensures the arm support 4 is securely held on the carrier platform 11.

In the mounted state, the carrier platform 11 is screw-connected to the arm support 4, the fixing screws (not shown), penetrating through corresponding openings 29 of the base element 25, cooperating with screw threads which are arranged in the dome-shaped support elements 15 which extend vertically downward from the underside 27 of the arm support 4.

A guide channel 31, which runs in the longitudinal direction 21 of the arm support and transversely with respect to the guide channels 22 of the base platform 9, is provided in the base element 25 of the carrier platform 11, said guide channel 31 extending over a substantial part of the length of the carrier platform 11.

A transfer element 13 is arranged between the carrier platform 11 and the arm support 4. The strip-shaped base body 33 of the transfer element 13 covers the guide channel 31 in part. In the region of the guide channel 31, the base body 33 has two lead-through openings 34 which are spaced apart from each other, the distance between the two lead-through openings 34 corresponding to the distance between the two guide channels 22 in the base platform 9.

Two non-illustrated lock screws are used to mount the carrier platform 11 on the base platform 9. The lock screws connect the transfer element to sliding blocks 36 through the openings 34 of the base body 33. By way of their necks 37, the sliding blocks 36 project through the guide channel 31 in the base element 25 of the carrier platform 11, as well as through the right-hand or left-hand guide channel 22 in the base platform 9. In other words, the necks 37 are inserted as guide elements in the guide channels 22, 31.

The main bodies 38 of the sliding blocks 36 attached to the necks 37 are arranged below the base platform 9 in the interior of the outer sleeve, which is widened at the upper end of the armrest column 2. The main bodies have transverse guide grooves 41, which are directed towards the underside 40 of the base platform 9 and which, in the mounted state, cooperate with guide webs 39 attached on the underside of the base platform 9, in order to ensure the carrier platform travels securely on the base platform 9. The guide grooves 41, in this case, run parallel to the guide channels 22.

Connected together in this manner, the arm support 4 with the carrier platform 11 can be moved within the framework of the guide channels 22, 31 in the longitudinal and transverse direction 5, 6 on the base platform 9 attached to the armrest column 2.

To provide for locking of the base platform 9 and the carrier platform 11 into different positions with respect to each other, a locking device with an actuating device is provided. The actuating device 44, just as the transfer element, is arranged in the inside space 48 formed between the carrier platform 11 and the arm support 4. The actuating device 44 includes an actuating element 49, which is displaceable in the interior of the inside space 48 transversely with respect to the longitudinal direction 21 of the arm support and consequently parallel to the guide channels 22 in the base platform 9. The actuating element 49 has two rows of teeth 52, 53, which are spaced apart from each other and run parallel to the guide channel 31 in the carrier platform 11.

The actuating element 49 is guided at, on or between guide webs 68, 69, which are provided extending in the transverse direction 6, on the one hand, on the upper side 32 of the base element 25 and, on the other hand, on the underside 27 of the arm support 4.

Two compression springs 62 that are arranged transversely with respect to the longitudinal direction 21 of the arm support serve to spring-load the actuating element 49, which, as a result, is always urged into a locking position. The compression springs 62 rest on corresponding guide pins 63 of the actuating element 49 and are supported on stop elements 64, which serve as abutments and are provided on the underside of the arm support 4.

In the locking position, the actuating element 49 is held in a spring-loaded manner in a position in which the teeth of the rows of teeth 52, 53 engage in correspondingly provided teeth of blocking elements 45, 55 for blocking the longitudinal and transverse movement.

A toothed rack 45, which runs parallel to the base body 33 of the transfer element 13 and is arranged vertically offset with respect to the base body 33, serves as the blocking element for blocking the longitudinal movement. A first toothed wheel 55, which is arranged centrally on the base body 33 of the transfer element 13 and is mounted there so as to be rotatable in an opening 57, serves as the blocking element for blocking the transverse movement.

The rows of teeth 52, 53 lie at the identical height as the teeth of the blocking elements 45, 55. If the actuating element 49 is moved in opposition to the spring force of the two compression springs 62 in the actuating direction 66, which runs parallel to the directions of the compression springs 62, at the same time the rows of teeth 52, 53 release the teeth of the blocking elements 45, 55. The locking between the base platform 9 and the carrier platform 11 is then released. An actuating control button 67 serves for operating the actuating element 49. The actuating control button 67 is released again to resume locking. The compression springs 62 press the actuating element 49 from the open position back into the locking position. At the same time, the rows of teeth 52, 53 engage in the nearest teeth of the blocking elements 45, 55.

The control button 67 for operating the actuating element 49 is connected to the actuating element 49 by means of a connecting rail 71 in such a manner that the control button 67 in the locking position projects in an only negligible manner beyond the outer edge of the arm support 4. A corresponding recess 72 in the retaining wall 28 is provided for the connecting rail 71. The recess 73 serves for receiving the control button 67.

Figure 6:
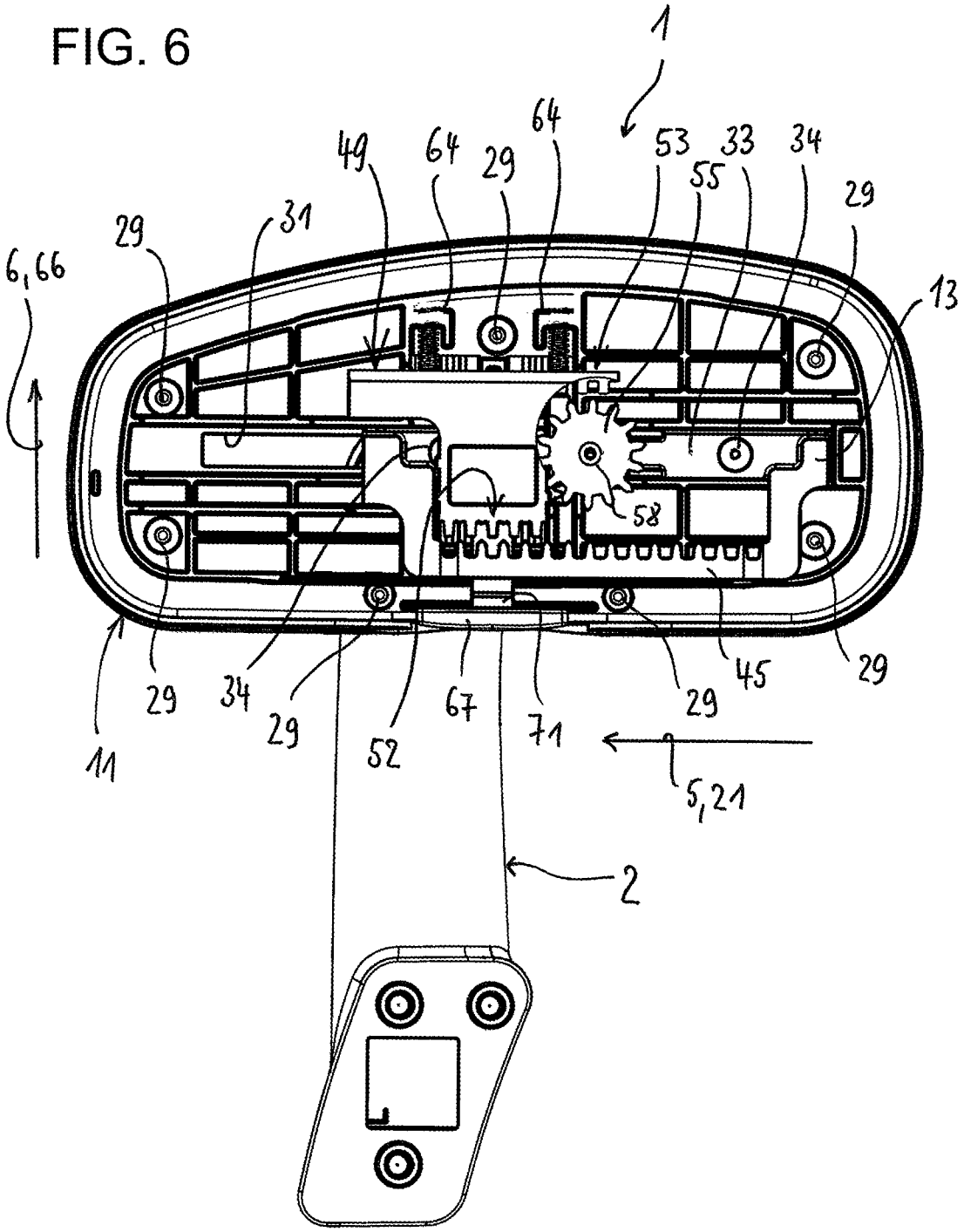
FIG. 6 shows a top view of the armrest with the arm support removed, in the open position.

If the control button 67, which is entrained with the carrier platform 11, is depressed, the teeth of the second row of teeth 53 of the actuating element 49 release the first toothed wheel 55, see FIG. 6 in which part of the actuating device has been cut away in order to make it possible to see the toothed wheel 55. As a result of this release, it is possible to rotate the first toothed wheel 55 about its axis of rotation 58, which extends both perpendicular to the longitudinal direction 5 and perpendicular to the transverse direction 6. A second toothed wheel 56, which is connected in a positive-locking manner to the first toothed wheel 55 by means of a locking element and which is arranged below the carrier platform 11, is able to roll off on a row of teeth 59, which is arranged on the base platform 9 in the transverse direction 6, as a result of which a guided transverse movement of the arm support 4 takes place. The locking element is in the form of a hexagonal pin, which is integrally formed on the second toothed wheel 56 and which projects through the guide channel 31 and is secured on the first toothed wheel 55 by means of a screw 60. The row of teeth 59 arranged on the base platform 9 is formed by one of the two longitudinal sides of a receiving opening 61, which is arranged centrally in the base platform 9, being provided with teeth. The receiving opening 61 is realized for receiving the second toothed wheel 56 and extends in a corresponding manner to the guide channels 22 almost over the entire width of the base platform 9. When the control button 67 is depressed, the movement unit made up by control button 67, carrier platform 11 and transfer element 13 is able to execute a movement in the transverse direction 6. In this case, this is a movement which is determined by the engagement of the second toothed wheel 56 in the row of teeth 59 and is consequently guided in a defined manner. The length of the row of teeth 59, consequently, determines the measurement of the possible transverse movement of the arm support 4.

When the control button 67 is depressed, the teeth of the first row of teeth 52 also move out of engagement with the teeth of the toothed rack 45, which extends in the longitudinal direction 5 and is realized as part of the transfer element 13. The toothed rack 45 is connected at the ends thereof to the base body 33 of the transfer element 13. In addition, two ribs 46 provide the connection between transfer element 13 and toothed rack 45. The ribs 46 provide the transverse guiding of the arm support 4. In the mounted state, they project through the carrier platform 11, which, for this purpose, has slot-shaped openings 47 which extend in the transverse direction 6 and intersect the guide channel 31. The ribs 46, which penetrate the carrier platform 11, are received by slotted grooves 42, which are inserted in the base platform 9 in the transverse direction 6 and are inserted into the base platform 9 on both sides of the receiving opening 61. Consequently, with the control button 67 depressed, the movement unit, produced from control button 67 and carrier platform 11, is able to be driven freely on both sides in the longitudinal direction 6 in relation to the transfer element 13, which is stationary in the longitudinal direction 6, i.e. without being guided by toothed wheel engagement or the like.

If the control button 67 is released again, that is if the teeth of the two rows of teeth 52, 53 of the actuating element 49 once again move into engagement with the teeth of the first toothed wheel 55 or of the toothed rack 45 of the transfer element 13, locking is resumed and the current transverse or longitudinal position of the arm support 4 in relation to the armrest column 2 is secured.

It will be clear to those of skill in the pertinent art that a plurality of further implementations and embodiments of the inventive concept are available that have not been described in full detail above. Those of skill in the art will understand that the various features represented in the description, the claims and the drawings can be fundamental to the invention both individually and in arbitrary combination with each other.

The following is a list of reference numerals used in the above description and may aid the reader in understanding the specification:

1 Armrest
2 Armrest column
3 Bearing head
4 Arm support
5 Longitudinal direction
6 Transverse direction
7 Vertical direction
8 Carrier
9 Base platform
11 Carrier platform
12 Opening
13 Transfer element
15 Support element
16 Opening
21 Longitudinal direction of the armrest
22 Guide channel
25 Base element
26 Support element
27 Underside of the armrest
28 Retaining wall
29 Opening
31 Guide channel
32 Upper side of base element
33 Base body
34 Lead-through opening
36 Sliding block
37 Neck
38 Main body

39 Guide web
40 Underside
41 Guide groove
42 Slotted groove
44 Actuating device
45 Toothed rack
46 Rib
47 Opening
48 Inside space
49 Actuating element
52 First row of teeth
53 Second row of teeth
54 Actuating control button
55 First toothed wheel
56 Second toothed wheel
57 Opening
58 Axis of rotation
59 Row of teeth
60 Locking screw
61 Receiving opening
62 Compression spring
63 Guide pin
64 Abutment
65 Inside
66 Direction of actuation
67 Actuating control button
68 Guide web
69 Guide web
71 Connecting rail
72 Recess
73 Recess

The invention claimed is:

1. An armrest, comprising:

an armrest column;

an arm support mounted on said armrest column; and a bearing head attached to said armrest column, said bearing head supporting said arm support on said armrest column and having a longitudinal adjustment mechanism for a longitudinal adjustment of said arm support and a transverse adjustment mechanism for a transverse adjustment of said arm support;

said bearing head including:

a stationary base platform connected to said armrest column;

a movable carrier platform connected to said arm support; and a locking device for detachably locking said base platform and said carrier platform in different positions with respect to one another;

said locking device including:

a transfer element disposed between said carrier platform and said arm support and connected to said base platform, said transfer element having first blocking elements for blocking the longitudinal adjustment of said arm support and second blocking elements for blocking the transverse adjustment of said arm support;

said transfer element being movably mounted in the transverse direction relative to said base platform, but stationary in the longitudinal direction; and an actuating element disposed between said carrier platform and said arm support, said actuating element having a control button for manual actuation and elements for simultaneously blocking or simultaneously releasing said first and second blocking elements of said transfer element.

2. The armrest according to claim 1, wherein said carrier platform is formed with a guide channel extending in the longitudinal direction and configured for receiving a part of said transfer element, such that said carrier platform is movable in the longitudinal direction relative to said transfer element.

3. The armrest according to claim 1, wherein, when said arm support is adjusted longitudinally, said carrier platform and said actuating element form one unit that is movable relative to said transfer element.

4. The armrest according to claim 3, wherein the longitudinal movement is a free travel movement.

5. The armrest according to claim 1, wherein, when the arm support is adjusted transversely, said carrier platform and said actuating element, together with said transfer element, form one unit that is movable relative to said base platform.

6. The armrest according to claim 5, wherein the transverse movement is a guided movement where said second blocking element or an element that is operatively connected to said second blocking element is guided in said base platform.

7. The armrest according to claim 1, wherein said first blocking element of said transfer element is a toothed rack extending in the longitudinal direction.

8. The armrest according to claim 1, wherein said second blocking elements of said transfer element include a toothed wheel that is rotatably mounted in said transfer element and is movable with said transfer element in the transverse direction.

9. The armrest according to claim 1, wherein the elements of said actuating element for blocking or releasing said first and second blocking elements comprises at least one row of teeth extending in the longitudinal direction.

10. The armrest according to claim 1, configured as an armrest for an office chair.

* * * * *